US006837609B1

(12) United States Patent
Kamoshida et al.

(10) Patent No.: US 6,837,609 B1
(45) Date of Patent: Jan. 4, 2005

(54) SOIL MODIFYING APPARATUS

(75) Inventors: Yasuhiro Kamoshida, Katano (JP); Yasuhiro Yoshida, Hirakata (JP)

(73) Assignee: Komatsu Ltd., Tokyo (JP)

( * ) Notice: Subject to any disclaimer, the term of this patent is extended or adjusted under 35 U.S.C. 154(b) by 10 days.

(21) Appl. No.: 10/390,241

(22) Filed: Mar. 17, 2003

(30) Foreign Application Priority Data

Jul. 30, 2002 (JP) ..... 2002-221312

(51) Int. Cl.[7] ..... B01F 15/02; E02D 3/12

(52) U.S. Cl. ..... 366/132; 366/141; 366/142; 366/152.1; 366/349; 241/34

(58) Field of Search ..... 366/132, 141, 366/142, 299, 349, 152.2, 152.6, 153.1; 241/33, 34, 63; 172/2; 700/239, 265

(56) References Cited

U.S. PATENT DOCUMENTS

| | | | | |
|---|---|---|---|---|
| 5,782,559 | A | * 7/1998 | Neier et al. | 366/349 |
| 5,803,376 | A | * 9/1998 | Koyanagi et al. | 241/101.74 |
| 5,906,436 | A | * 5/1999 | Cole et al. | 366/346 |
| 5,988,937 | A | * 11/1999 | Komoriya et al. | 241/101.74 |
| 6,000,641 | A | * 12/1999 | Komoriya et al. | 241/29 |
| 6,004,023 | A | * 12/1999 | Koyanagi et al. | 241/34 |
| 6,059,447 | A | * 5/2000 | Paris | 366/271 |
| 6,171,030 | B1 | 1/2001 | Miyake et al. | |
| 6,183,159 | B1 | * 2/2001 | Hashimoto et al. | 404/76 |
| 6,412,974 | B1 | * 7/2002 | Scholl et al. | 366/191 |
| 6,595,446 | B1 | * 7/2003 | Kamoshida et al. | 241/101.74 |
| 6,719,449 | B1 | * 4/2004 | Laugharn et al. | 366/127 |

FOREIGN PATENT DOCUMENTS

| | | | |
|---|---|---|---|
| DE | 44 36 659 | * | 4/1995 |
| EP | 0 915 205 A1 | | 5/1999 |
| EP | 0 974 702 A2 | | 1/2000 |
| EP | 1 087 064 | * | 3/2001 |
| EP | 1 094 160 A2 | | 4/2001 |
| EP | 1 387 009 | * | 2/2004 |
| WO | WO 97/25486 | * | 7/1997 |

OTHER PUBLICATIONS

Derwent Information Ltd. 1999. Derwent Abstracts of DE 4436659, 3 pgs.*

* cited by examiner

*Primary Examiner*—Tony G. Soohoo
(74) *Attorney, Agent, or Firm*—Frishauf, Holtz, Goodman & Chick, P.C.

(57) ABSTRACT

A soil modifying apparatus capable of making accurate production management and controlling a mixture ratio with excellent precision is provided. For this purpose, the apparatus includes target processing amount setting means (21) for a raw soil material, actual raw soil material amount detecting means (12), actual raw soil material amount calculating means **(47*a*), raw soil material feeder speed detecting means (16), predicted raw soil material amount calculating means (43) for calculating a predicted supply amount per hour of the raw soil material, first comparing means (48) for comparing the actual processing amount per hour of the raw soil material, and the predicted supply amount, and raw soil material feeder speed correcting means (25) for correcting a target value of the raw soil material feeder speed based on a comparison result of the first comparing means to control the speed of the raw soil material feeder (8)**.

5 Claims, 9 Drawing Sheets

SOIL MODIFYING APPARATUS

TECHNICAL FIELD

The present invention relates to a soil modifying apparatus, and it particularly relates to a soil modifying apparatus suitable for production control.

BACKGROUND ART

For example, a self-propelled soil modifying apparatus is cited as a soil modifying apparatus for shredding and mixing a raw soil material such as so-called surplus soil and earth and sand, which are excavated in the sites of road construction and building construction, and a modifying material such as lime to produce modified soil which is reused for backfill and the like. As the self-propelled soil modifying apparatus, the one disclosed in, for example, Japanese Patent Laid-open No. 11-165878 is known, and FIG. 10 is a side view of the self-propelled soil modifying apparatus disclosed in Japanese Patent Laid-open No. 11-165878.

As shown in FIG. 10, a left and right lower travelling units 62 are attached to a vehicle body 61, and a mixer 63 is mounted on a longitudinally middle part of the vehicle body 61. A driving unit 64 such as an engine, a hydraulic pump and an operation valve is mounted on a part near the rear of the vehicle body 61. A mounting frame 66 is attached to a part near the front of the vehicle body 61, and a raw soil material transfer device 67 is attached to the mounting frame 66, facing to a longitudinal direction. A raw soil material hopper 68 is attached to a part near the front of the mounting frame 66 and a modifying material supply device 69 is attached to a part near the rear thereof, each located above the raw soil material transfer device 67. A modified soil transfer device 70 is attached to the lower part of the vehicle body 61, facing in the longitudinal direction. One side portion in the transfer direction (the part near the front) of the modified soil transfer device 70 is located under the mixer 63 and the other side portion in the transfer direction (the part near the rear) of the modified soil transfer device 70 is projected rearward from the vehicle body 61.

An operation according to the above-described constitution will be explained. The raw soil material charged into the raw soil material hopper 68 with a loader (not shown) or the like is transferred by the raw soil material transfer device 67 in fixed amount. A predetermined amount of modifying material corresponding to a target mixture ratio is supplied to the raw soil material on the raw soil material transfer device 67 from the modifying material supply device 69, and these raw soil material and modifying material are supplied into the mixer 63 by the raw soil material transfer device 67. In the mixer 63, the raw soil material and the modifying material are mixed, then mixed modified soil (product) coming out of it is transferred to the place behind the vehicle body 61 by the modified soil transfer device 70, and loaded on a dump truck outside or piled on the ground.

However, the self-propelled soil modifying apparatus as disclosed in Japanese Patent Laid-open No. 11-165878 has the following problems. In production of the reformed soil as a product, it is very important to enhance production efficiency and lower production cost, to control production with excellent precision based on a production plan and the like. However, the production amount per hour of the modified soil (product) produced with the self-propelled soil modifying apparatus is sometimes varied due to various factors as described below.

For example, the amount of the raw soil material transferred by the raw soil material transfer device 67 is varied according to the loading amount in the raw soil material hopper 68, the kind of raw soil material, torque fluctuation of a driving motor of the transfer device 67 and the like. The amount of the modifying material supplied from the modifying material supply device 69 is varied according to the storage amount inside the modifying material hopper of the supply device 69, a variation in the specific gravity of the modifying material, a torque fluctuation of the supply motor of the supply device 69 and the like. Further, the amount of the modified soil transferred with the modified soil transfer device 70 is varied according to the torque fluctuation of the driving motor of the transfer device 70 and the like. The production amount of the modified soil per hour is varied due to these varying factors, thus causing the problem that production management of the modified soil cannot be performed with excellent precision. The raw soil material supply amount and the modifying material supply amount per hour are varied respectively, and thereby the mixture ratio is varied, thus causing the problem that it is difficult to obtain the modified soil with a highly precise mixture ratio.

SUMMARY OF THE INVENTION

The present invention is made in view of the above-described problems, and has its object to provide a soil modifying apparatus capable of making accurate production management and controlling a mixture ratio with excellent precision.

A first aspect of the soil modifying apparatus according to the present invention includes: target processing amount setting means for setting a target processing amount per hour of a raw soil material; actual raw soil material amount detecting means for detecting an actual processing amount of the raw soil material in time sequence; actual raw soil material amount calculating means for calculating an actual processing amount per hour of the raw soil material from a detection value of the actual raw soil material amount detecting means; raw soil material feeder speed detecting means for detecting a speed of a raw soil material feeder; predicted raw soil material amount calculating means for calculating a predicted supply amount per hour of the raw soil material based on the detected raw soil material feeder speed; first comparing means for comparing the calculated actual processing amount per hour of the raw soil material, and the calculated predicted supply amount as a target processing amount per hour of the raw soil material; and raw soil material feeder speed correcting means for correcting a target value of the raw soil material feeder speed obtained from the set target processing amount per hour of the raw soil material, based on the comparison result of the first comparing means, and controlling the speed of the raw soil material feeder according to the corrected target value.

According to the above first constitution, the target processing amount per hour of the raw soil material is set, the actual processing amount of the raw soil material is detected during the actual operation and fed back, and based on the comparison result of the target processing amount and the actual processing amount, the speed of the raw soil material feeder is corrected and controlled so that the actual processing amount becomes equal to the target processing amount. As a result, the processing amount per hour of the raw soil material can be controlled with excellent precision. Consequently, by controlling the speed of the raw soil material feeder at a suitable speed, it becomes possible to keep productivity and a mixture property at proper values, and production management can be accurately performed. In addition, the mixture ratio can be controlled with excellent precision, and therefore modified soil of good quality can be produced.

In the raw soil modifying apparatus, the actual raw soil material detecting means may be a conveyer scale provided at the raw soil material feeder part for supplying the raw soil material into a mixer, or a conveyor scale provided at a modified soil discharging conveyor part for discharging modified soil to an outside from the mixer. According to the constitution, the actual processing amount of the raw soil material is detected by the conveyor scale provided at the raw soil material feeder part or the modified soil discharging conveyor part, and therefore it can be accurately detected with a simple constitution.

A second constitution of the soil modifying apparatus according to the present invention includes: target processing amount setting means for setting a target addition processing amount per hour of a modifying material; actual modifying material amount detecting means for detecting an actual addition processing amount of the modifying material in time sequence; actual modifying material amount calculating means for calculating an actual addition processing amount per hour of the modifying material from a detection value of the actual modifying material amount detecting means; modifying material feeder speed detecting means for detecting a speed of a modifying material feeder; predicted modifying material amount calculating means for calculating a predicted addition amount per hour of the modifying material based on the detected modifying material feeder speed; second comparing means for comparing the calculated actual addition processing amount per hour of the modifying material, and the calculated predicted addition amount as a target addition processing amount per hour of the modifying material; and modifying material feeder speed correcting means for correcting a target value of the modifying material feeder speed obtained from the set target addition processing amount per hour of the modifying material, based on the comparison result of the second comparing means, and controlling the speed of the modifying material feeder according to the corrected target value.

According to the above second constitution, the target addition processing amount per hour of the modifying material as well as the raw soil material is set, and the actual addition processing amount of the modifying material is detected and fed back during an actual operation, and based on the result of comparing the target addition processing amount and the actual addition processing amount, the speed of the modifying material feeder is corrected and controlled so that the actual addition processing amount becomes equal to the target addition processing amount. Thereby, the addition processing amount per hour of the modifying material can be controller with excellent precision. Consequently, it is possible to control the mixture ratio to be a predetermined target mixture ratio accurately, and modified soil of good quality can be produced.

In the soil modifying apparatus, the actual modifying material detecting means may be a load cell for measuring weights of the modifying material and a modifying material hopper for storing the modifying material. According to the constitution, the actual addition processing amount of the modifying material is detected by detecting the weight of the modifying material and the modifying material hopper with the load cell. As a result, the addition weight of the modifying material can be detected more accurately as compared with the conventional method of measuring, for example, the modifying material addition volume and converting it into the modifying material weight by using data such as specific gravity. Accordingly, the mixture ratio can be more accurately managed and the production amount of the modified soil can be managed with excellent precision.

A third constitution of the soil modifying apparatus according to the present invention includes: target processing amount setting means for setting a target processing amount per hour of a raw soil material, and a target addition processing amount per hour of a modifying material; actual raw soil material amount detecting means for detecting an actual processing amount of the raw soil material in time sequence; actual raw soil material amount calculating means for calculating an actual processing amount per hour of the raw soil material from a detection value of the actual raw soil material amount detecting means; raw soil material feeder speed detecting means for detecting a speed of a raw soil material feeder; predicted raw soil material amount calculating means for calculating a predicted supply amount per hour of the raw soil material based on the detected raw soil material feeder speed; first comparing means for comparing the calculated actual processing amount per hour of the raw soil material, and the calculated predicted supply amount as a target processing amount per hour of the raw soil material; and raw soil material feeder speed correcting means for correcting a target value of the raw soil material feeder speed obtained from the set target processing amount per hour of the raw soil material, based on a comparison result of the first comparing means, and controlling the speed of the raw soil material feeder according to the corrected target value; actual modifying material amount detecting means for detecting an actual addition processing amount of the modifying material in time sequence; actual modifying material amount calculating means for calculating an actual addition processing amount per hour of the modifying material from a detection value of the actual modifying material amount detecting means; modifying material feeder speed detecting means for detecting a speed of a modifying material feeder; predicted modifying material amount calculating means for calculating a predicted addition amount per hour of the modifying material based on the detected modifying material feeder speed; second comparing means for comparing the calculated actual addition processing amount per hour of the modifying material, and the calculated predicted addition amount as a target addition processing amount per hour of the modifying material; modifying material feeder speed correcting means for correcting a target value of the modifying material feeder speed obtained from the set target addition processing amount per hour of the modifying material, based on the comparison result of the second comparing means, and controlling the speed of the modifying material feeder according to the corrected target value.

According to the above third constitution, the actual processing amount of the raw soil material and the actual addition processing amount of the modifying material can be controlled with excellent precision so as to become equal to the target processing amount of the raw soil material and the target addition processing amount of the modifying soil material, and therefore the production amount of the modified soil can be accurately managed to make it possible to facilitate the production management and control the precision of the mixture ratio of the modified soil to be excellent.

BEST MODE FOR CARRYING OUT THE INVENTION

Embodiments of the present invention will be explained in detail below with reference to the drawings.

Figure 1:
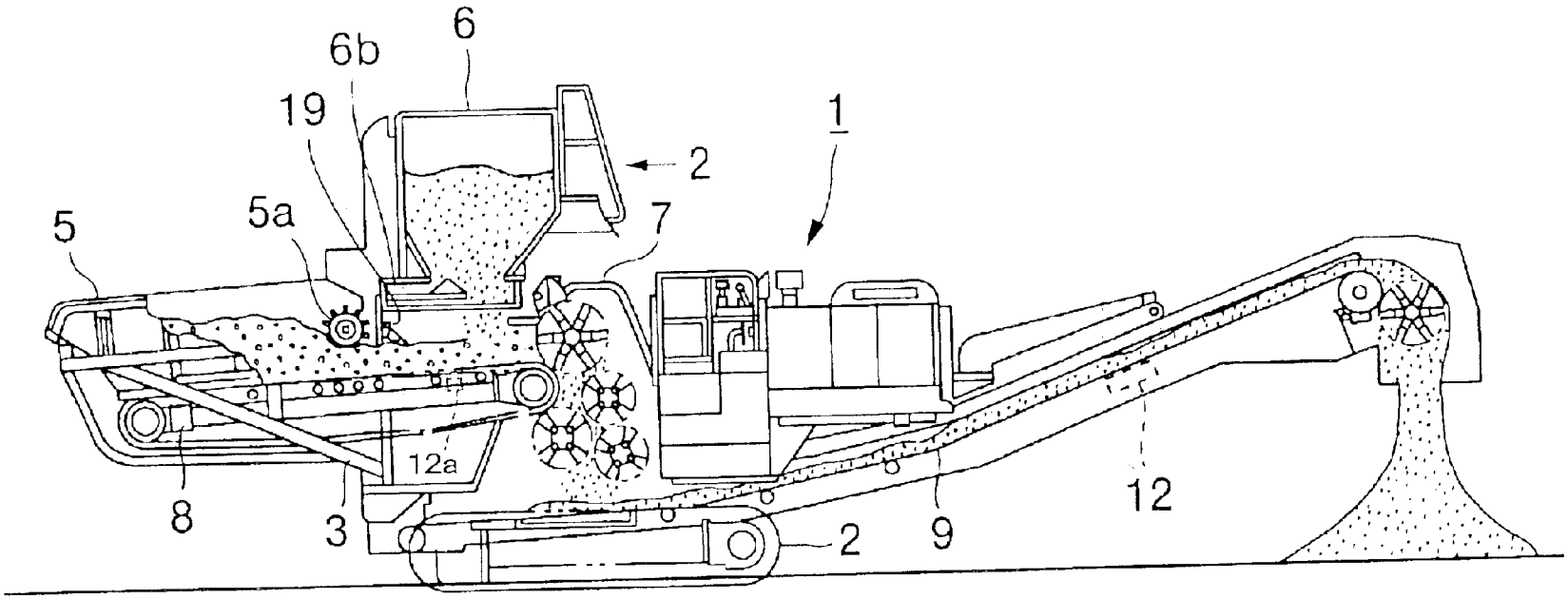
FIG. 1 is a side view of a self-propelled soil modifying apparatus according to the present invention.
Figure 2:
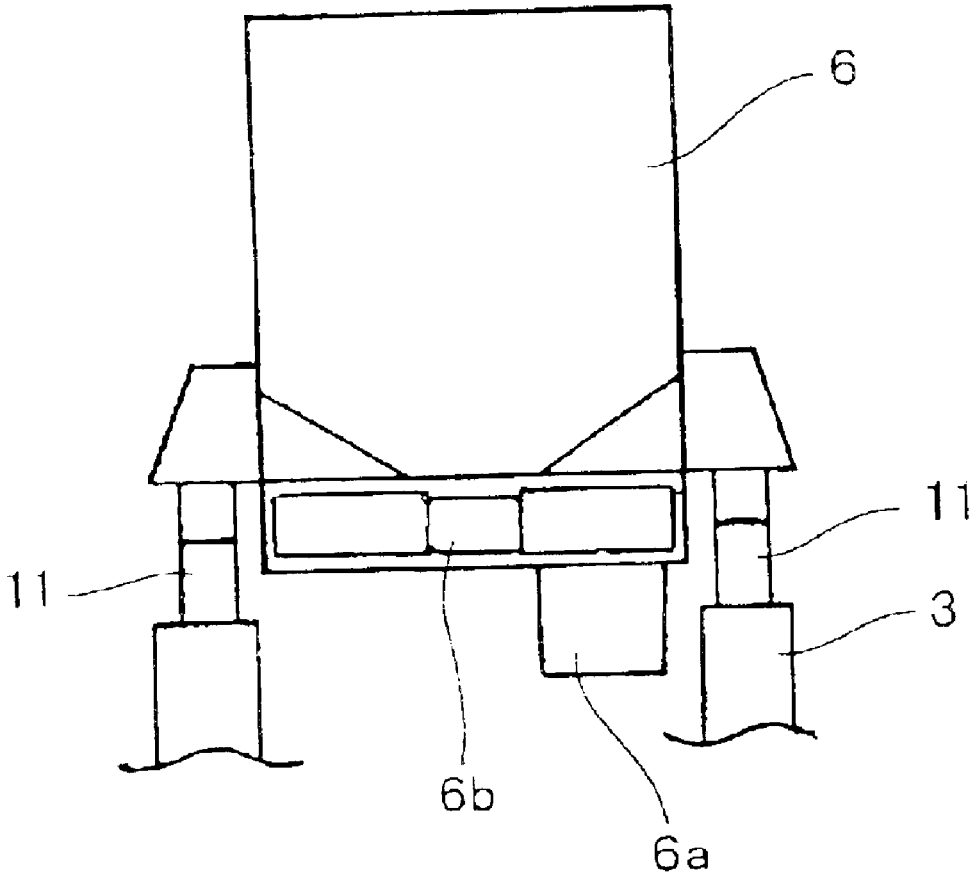
FIG. 2 is a view seen in a direction of the arrow 2 in FIG. 1.

FIG. 1 is a side view of a self-propelled soil modifying apparatus as an application example of a soil modifying apparatus according to the present invention, FIG. 2 is a view seen in the arrow 2 in FIG. 1, which shows a front view of a modifying material hopper mounting section. In FIG. 1, a self-propelled soil modifying apparatus 1 includes a lower traveling unit 62 having crawler type traveling equipment, and a base stand 3 is mounted on an upper part of the lower travelling unit 62. A raw soil material hopper 5 for storing a raw soil material is included on an upper part of one side in a longitudinal direction of the base stand 3 is included, and a raw soil material feeder 8 constituted by a conveyor for transferring the raw soil material from a discharge port of the raw soil material hopper 5, and the like is placed under the raw material hopper 5. A scraping rotor 5*a* for scraping out the raw soil material from the raw soil material hopper 5 and transferring it with the raw soil material feeder 8 is attached at a discharge port of the raw soil material hopper 5 to be freely driven rotatively. A mixer 7 is mounted on an upper part of substantially a center of the base stand 3, and an end portion at a downstream side of transfer of the raw soil material feeder 8 is placed to face to an input port of the miser 7.

A modifying material hopper 6 for storing a modifying material is provided above the raw soil material feeder 8, between the raw soil material hopper 5 and the mixer 7. A modifying material feeder 6*b* shown in FIG. 2 with the modifying material supply amount being made controllable by controlling the rotational speed of a rotary feeder is placed at a lower part of the modifying material hopper 6. A modifying material chute 6*a* is provided at a modifying material discharge port at a lower part of the modifying material feeder 6*b*, and the modifying material is added onto the raw soil material transferred with the raw soil material feeder 8 via the modifying chute 6*a*. A raw soil material presence or absence sensor 19 for detecting presence or absence of the raw oil material on the raw soil material feeder 8 is provided between the discharge port of the raw soil material hopper 5 and the modifying material chute 6*a*.

Inside the mixer 7, included are a primary cutter for primarily shredding and mixing the supplied raw soil material and modifying material, and a secondary cutter for secondarily mixing it. A modified soil discharge conveyor 9 for discharging the modified soil produced by shredding and mixing the raw soil material and the modifying material in the mixer 7 to an outside is placed under the mixer 7. A downstream side of the modified soil discharge conveyor 9 is provided to face upward lo outside the other end side in the longitudinal direction from the base stand 3. In a predetermined section in a middle part of the modified soil discharging conveyor 9, provided is a conveyor scale 12 for measuring the weight of the modified soil on the conveyor in the section.

As shown in FIG. 2, a load cell 11 for measuring the modifying material addition weight is provided at the lower part of the modifying material hopper 6, and the modifying material hopper 6 is mounted on the base stand 3 via the load cell 11. The load cell 11 measures a total value of a weight of the modifying material hopper 6 and the modifying material feeder 6*b* and a weight of the modifying material inside the modifying material hopper 6 and the modifying material feeder 6*b*. As will be described later, an actual adding amount of the modifying material is obtained according to an amount of change in the weight measurement value by the load cell 11.

Figure 3:
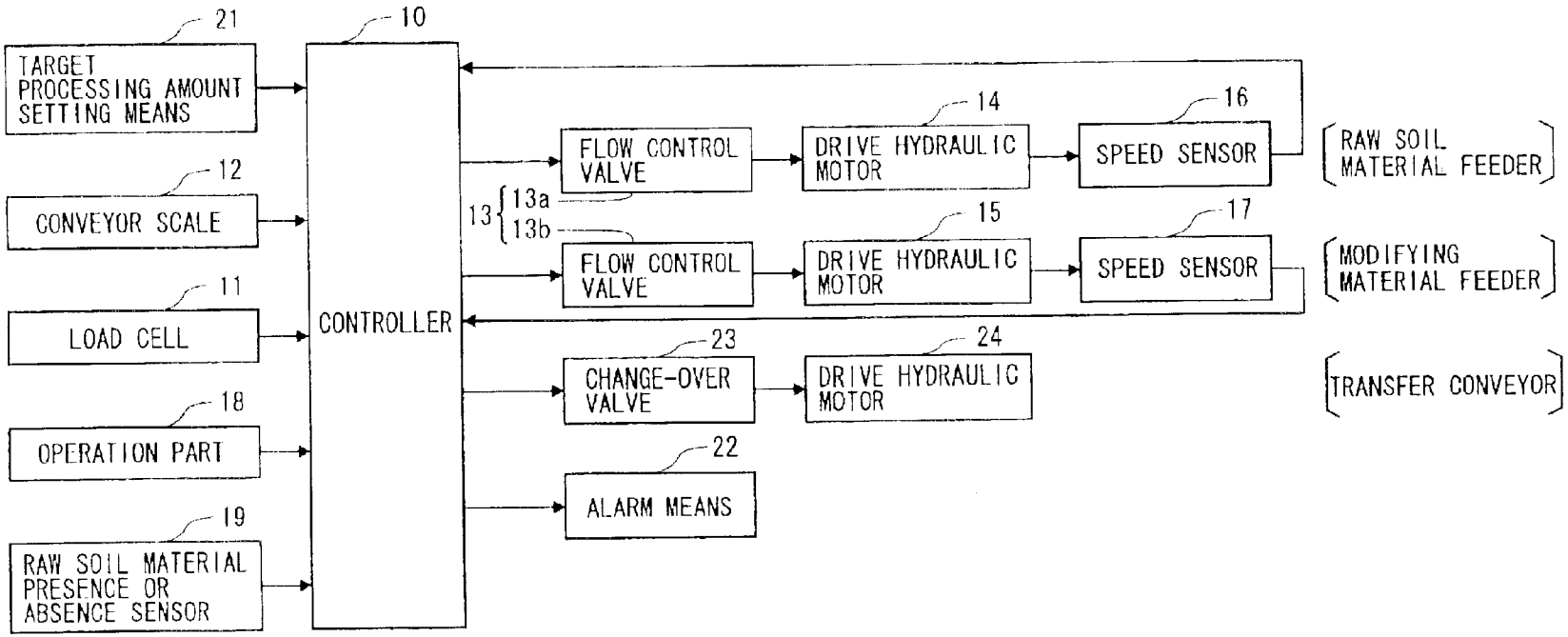
FIG. 3 is a block diagram of a constitution of a control unit according to a first embodiment of the present invention.

Next, a first embodiment will he explained based on FIG. 3 to FIG. 6. FIG. 3 is a block diagram of a hardware constitution of a control unit according to the first embodiment. The hardware constitution will be explained based on FIG. 3. An actual processing weight or an actual processing volume of the raw soil material is generally called an actual processing amount, and an actual addition weight or an actual addition volume of the modifying material is generally called an actual addition amount. A predicted processing weight or a predicted processing volume of the raw soil material is generally called a predicted processing amount.

Target processing amount setting means 21 sets a target processing weight or target processing volume (hereinafter, both are generally called a target processing amount) of the raw soil material per hour, and a target addition weight or a target addition volume (hereinafter, both are generally called a target addition amount) of the modifying material per hour, respectively. The target processing amount setting means 21 is constituted by, for example, a key board, a switch exclusively for setting, a dial-attached setting volume or the like. The above-described target weight and target volume of the raw soil material and the modifying material can be converted into each other with use of specific gravity of the raw soil material and the specific gravity of the modifying material, and therefore at least either one of the target weight or the target volume may be set. In this embodiment, the target processing weight of the raw soil material per hour (a target raw soil material weight Wj), and a weight addition rate Vj of the modifying material are set, and based on this, the target addition weight of the modifying material per hour is obtained from a mathematical expression "target raw soil material weight Wj× weight addition rate Vj".

Instead of setting the target processing amount of the raw soil material and the target addition amount of the modifying material, a target production weight or a target production volume (hereinafter, both are generally called a target production amount) of the modified soil per hour, and mixture ratio (for example, a weight ratio or a volume ratio of the raw soil material and the modifying material) are set, and according to them, the target processing amount of the raw soil material and the target addition amount of the modifying material may be calculated. If the specific gravity of the modified soil is assumed to be known, at least either one of the target production weight or the target production volume of the modified soil may be set.

An operation part 18 to input data is included, and values of specific gravity of the raw soil material details of which will be described later, an addition rate (the ratio of the modifying material addition weight to the raw soil material processing weight), a water content ratio of the raw soil material (weight of water contained in the raw soil material of unit weight), modifying material specific gravity (initial value of modifying material specific value) and the like are inputted and are previously stored in a controller 10 before start of an operation.

As actual raw soil material amount detecting means for detecting the actual processing amount of the raw soil material, the actual production weight of the modified soil is detected with the conveyor scale 12 in this embodiment, and means for calculating the actual processing amount of the raw soil material with reference to the mixture ratio and the like based on this modified soil actual production weight is used. The actual processing weight value of the raw soil material measured by the conveyor scale 12, and the weight value of the modifying material measured by the load cell 11 are inputted into the controller 10. The raw soil material presence or existence sensor 19 is constituted by, for example, a limit switch or the like for detecting the transfer height of the raw soil material on the raw soil material feeder 8, and the presence or absence detecting signal is inputted into the controller 10.

A first flow control valve 13*a* receives a flow rate command for a drive hydraulic motor 14 of the raw soil material feeder 8 which the controller 10 arithmetically operates and obtains based on control processing, then controls pressure oil discharged from a hydraulic pump (not shown) and outputs a flow rate corresponding to the aforesaid flow rate command (including a stop command) to control rotational frequency of the drive hydraulic motor 14. A second flow control valve 13*b* receives a flow rate command for a drive hydraulic motor 15 of the modifying material feeder 6*b* from the controller 10, then controls pressure oil discharged from the hydraulic pump (not shown) and outputs a flow rate corresponding to the aforementioned flow rate command (including the stop command) to control rotational frequency of the drive hydraulic motor 15. The rotational frequencies of the drive hydraulic motors 14 and 15 are detected by speed sensors 16 and 17, respectively, and are fed back to the controller 10.

A change-over valve 23 drives or stops a drive hydraulic motor 24 of the modified soil discharging conveyor 9, and it receives a drive or stop command from the controller 10, then controls pressure oil discharged from a hydraulic pump (not shown), and outputs a flow rate corresponding to the aforementioned drive or stop command to drive the drive hydraulic motor 24.

The controller 10 has a high-speed arithmetic unit and a storage unit (not shown) such as a computer, and previously stores each data such as the raw soil material target processing amount and modifying material target addition processing amount that are set by the target processing amount setting means 21, and the modifying material weight addition rate (mixture ratio), the raw soil material density, and the modifying material specific gravity that are inputted from the operation part 18. At the time of an actual control, the actual production amount of the modified soil, which is measured by the conveyor scale 12 at each predetermined time, and the actual addition amount of the modifying material, which is measured by the load cell 11 at each predetermined time, are inputted, and based on these inputted data, predetermined arithmetic processing that will be described later is performed. Based on the comparison result of the actual processing amount of the raw soil material per hour and the stored target processing amount, and the comparison result of the actual addition processing amount of the modifying material per hour and the stored target addition processing amount, the speed of the raw soil material feeder 8 and the modifying material feeder 6*b* are corrected and controlled, so that the actual production amount per hour of the modified soil (mixture of the raw soil material and the modifying material) becomes equal to the target production amount. In this situation, when the actual production amount per hour of the modified soil varies by a predetermined value or more with respect to the target production amount, it is indicated to an outside by alarm means 22.

The alarm means 22 receives an alarm command from the controller 10, and gives an alarm indicating that the production amount of the modified soil per hour varies by a predetermined value or more with respect to the target production amount. The alarm means 22 is constituted by an combination of alarm such as a buzzer and a chime, an indicator such as a patrol light and a lamp indicator, and a character indicator displaying a warning message, an error number and the like.

Figure 4:
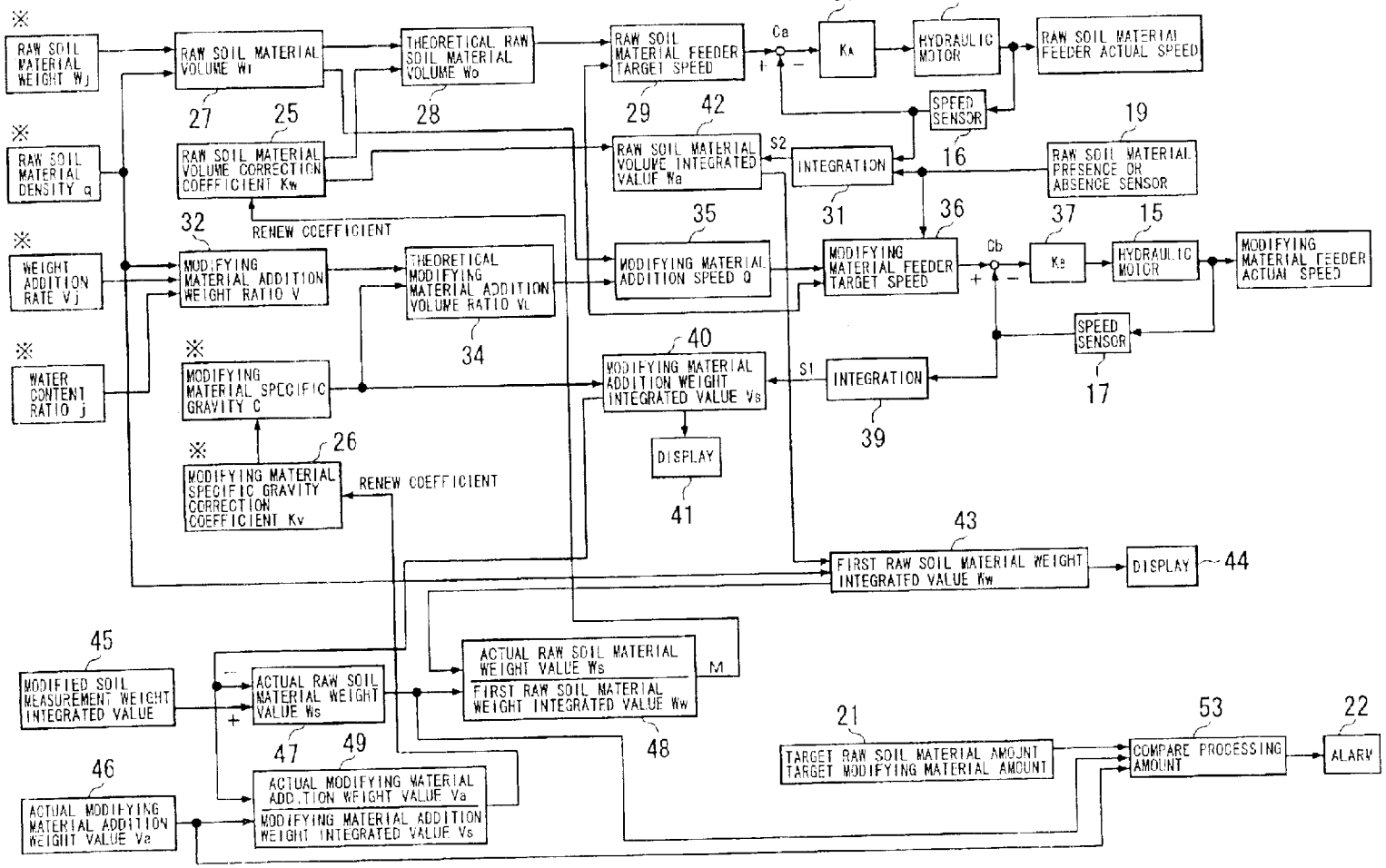
FIG. 4 is a block diagram of a control function of the first embodiment.

Next, an arithmetic operation processing procedure of the controller 10 according to the first embodiment will be explained based on a control function block diagram shown in FIG. 4. In FIG. 4, the data set by an operator, each name of data obtained by arithmetic operation, or its function and the like are described in a block expressing each of the functions. In FIG. 4, the blocks given symbols "*" are the values set by the operator. However, as for KW, C and KV, only the initial values are inputted by the operator.

The operator previously sets in the controller 10 the target raw soil material weight Wj per hour, a raw soil material density q, the weight addition rate Vj, a water content ratio j, a raw soil material volume correction coefficient Kw, a modifying material specific gravity C, a modifying material specific gravity correction coefficient Kv and the like. Here, the target raw soil material weight Wj expresses the target processing amount of the raw soil material per hour (unit: for example, t/H), and the raw soil material density q expresses the raw soil material weight per unit volume (unit: for example, $t/m^3$). The weight addition rate Vj expresses a weight addition ratio of the modifying material to the raw soil material of unit weight (unit: for example %), and the water content ratio j expresses a weight ratio of water in the raw soil material of the unit weight (unit: for example, %). The raw soil material volume correction coefficient Kw is a coefficient to correct the raw soil material volume of the target working amount according to a deviation between actual figures (substantially close to an actual measurement value) of the raw soil material weight used and the target value, and its initial value is usually set at 1. The modifying material specific gravity C is the weight of the modifying material per unit volume (unit: for example, $t/m^3$). The modifying material specific gravity correction coefficient Kv is a coefficient to correct the modifying material specific gravity C used for arithmetically operating the target modifying material addition volume according to a deviation between the actual measurement value of the modifying material addition weight and the target value, and its initial value is usually set at 1.

At a time of starting the control, the controller 10 firstly obtains a raw soil material volume per hour WT to be processed per hour (unit: for example, $m^3/H$) from the mathematical expression "WT=Wj/q", as the target working amount, based on the set target raw soil material weight Wj and the raw soil material density q in a raw soil material volume operation part 27.

At a time of the control, the controller 10 firstly obtains a theoretical raw soil material volume W0 to be processed per hour according to the mathematical expression "W0=WT/Kw" based on the obtained raw soil material volume WT per hour and the set raw soil material volume correction coefficient Kw in a theoretical raw soil material volume operation part 28. Next, the controller 10 arithmetically operates a target speed of the raw soil material feeder 8 which meets the obtained theoretical raw soil material volume W0 per hour in a raw soil material feeder target speed operation part 29, and outputs it as a speed command Ca. Then, a raw soil material feeder speed control part 30 controls a flow rate of the first control valve 13*a* of the flow control valve 13 corresponding to a deviation value between the speed command Ca and a speed feedback signal from a speed sensor 16 of the raw soil material feeder 8, and controls the rotational frequency of the drive hydraulic motor 14 of the raw soil material feeder 8.

At the time of starting the control, the controller 10 firstly obtains an addition weight ratio V (unit: for example, $kg/m^3$) of the modifying material to the real raw soil material which is obtained by removing the water content from the raw soil material per unit volume according to the mathematical expression "V=q×Vj×(1−j)", based on the set raw soil material density q, weight addition rate Vj and water content ratio j, in a modifying material addition weight ratio operation part 32.

At a time of the control, at first, the controller 10 arithmetically operates a theoretical modifying material addition volume ratio VL (unit: for example, $litter/m^3$) expressing the modifying material addition volume to the raw soil material according to the mathematical expression "VL=V/Cn", based on the obtained addition weight ratio V of the modifying material to the real raw soil material, and a modifying material specific gravity Cn which is corrected by the set modifying material specific gravity correction coefficient Kv (=Cn−1×Kv, where n expresses the number of arithmetic operations for each predetermined servo operation period time), in a theoretical modifying material addition volume ratio operation part 34. Next, the controller 10 arithmetically operates a modifying material addition speed Q (unit: for example, litter/H) expressing the modifying material added per hour according to the mathematical expression "Q=WT×VL", based on the obtained theoretical modifying material addition volume ratio VL and the obtained raw soil material volume WT processed per hour, in a modifying material addition speed operation part 35, and outputs it as a modifying material addition speed target value.

Meanwhile, a detection signal of a state of presence or absence of the raw soil material by the raw soil material presence or absence sensor 19 is inputted into an integrator 31 and a modifying material feeder target speed operation part 36. In the modifying material feeder target speed operation part 36, the controller 10 obtains the speed of the drive hydraulic motor 15 of the modifying material feeder 6*b*, which satisfies the target value of the modifying material addition speed Q obtained in the modifying material addition speed operation part 35, and outputs this as a speed command Cb. The speed command Cb is obtained based on a relational expression expressing the relationship between a rotational speed of the drive hydraulic motor 15 of the modifying material feeder 6*b* and the modifying material addition amount, or a data table. In this situation, while a signal indicating the absence of the raw soil material is inputted from the raw soil material presence or absence sensor 19, the speed command Cb is forced to be zero to stop addition of the modifying material temporarily. Next, in a modifying material feeder speed control part 37, the controller 10 controls the flow rate of the second control valve 13*b* of the flow control valve 13 according to a deviation value between the obtained speed command Cb and a speed feedback signal from the speed sensor 17 of the modifying material feeder 6*b* to control the rotational frequency of the drive hydraulic motor 15 of the modifying material feeder 6*b*.

Next, in an integrator 39, the controller 10 arithmetically operates an integrated value S1 of the speed of the modifying material feeder 6*b* based on the speed feedback signal from the speed sensor 17 for a predetermined unit lime T0 (for example, one hour). Then, in an modifying material addition weight integrated value operation part 40, the controller 10 obtains an integrated value Vs of the modifying material addition weight per predetermined unit time T0 according to the mathematical expression "Vs=S1×Cn", from the integrated value S1 and the modifying material specific gravity Cn, based on the relationship between the rotational speed of the drive hydraulic motor 15 and the modifying material addition amount. The modifying material addition weight integrated value Vs is displayed on an indicator (not shown).

Next, the controller 10 arithmetically operates a speed integrated value S2 (namely, expresses a transfer distance of the raw soil material) of the raw soil material feeder based on the speed feedback signal from the speed sensor 16 for the predetermined unit time T0 (for example, one hour) in the integrator 31. In this situation, while the signal indicating the absence of the raw soil material is inputted from the raw soil material presence or absence sensor 19, the speed integrated value S2 is forced to be zero, so that the raw soil material processing amount during this time is not added. Then, in a raw soil material volume integrated value operation part 42, the controller 10 obtains a raw soil material volume integrated value Wa per the predetermined unit time T0 according to the mathematical expression "Wa=S2×U×Kw" from the speed integrated value S2, a previously set transfer area U of the raw soil material (namely, width of the raw soil material feeder × raw soil material height), and the raw soil material volume correction coefficient Kw. The raw soil material volume integrated value Wa becomes a predicted value of the raw soil material volume processed per the predetermined unit time T0.

In a first raw soil material weight integrated value operation pan 43, the controller 10 arithmetically operates a first soil material weight integrated value Ww according to the mathematical expression "Ww=Wa×q", as a predicted value of the raw soil material processing weight per the predetermined unit time T0, based on the obtained raw soil material volume integrated value Wa per the predetermined unit time T0 and the raw soil material density q. The controller 10 integrates the modified soil weight value measured at each predetermined measuring time by the conveyor scale 12 provided at the modified soil discharging conveyor 9 for the predetermined unit time T0 (for example, one hour) in a modified soil measurement weight integrated value operation part 45 to obtain a modified soil measurement weight integrated value (hereinafter, called an actual modified soil production weight). Next, in an actual raw soil material weight value operation part 47, the controller 10 subtracts the modifying material addition weight integrated value Vs per the predetermined unit time T0 as the actual modifying material addition amount from the obtained actual modified soil production weight to obtain the value as an actual raw soil material weight value Ws per the predetermined unit time T0.

Further, in a raw soil material weight correction rate operation part 48, the controller 10 obtains a ratio M of the obtained actual raw soil material weight value Ws per the predetermined unit time T0 and the first raw soil material weight integrated value Ww as the target raw soil material weight per the predetermined unit time T0. Next, in a raw soil material volume correction coefficient operation part 25, the controller 10 obtains a new raw soil material volume correction coefficient Kw according to the mathematical expression "Kw×M" with use of the obtained ratio M and the raw soil material volume correction coefficient Kw up to now and updates this. Thereby, the controller 10 performs the control so that the actual processing weight of the raw soil material per predetermined unit time T0 becomes equal to the set target raw soil material weight Wj.

In an actual modifying material addition weight value operation part 46, an actual modifying material addition weight value Va for the predetermined unit time T0 is arithmetically operated based on the weight value measured with the load cell 11. Namely, a difference between the weight measurement value by the load cell 11 at each predetermined measuring time and the previous measurement value is the actual modifying material addition weight between them, and this actual modifying material addition weight is integrated for the predetermined unit time T0 to obtain the actual modifying material addition weight value Va. Next, in a modifying material specific gravity correction rate operation part 49, the controller 10 obtains a ratio P of the obtained actual modifying material addition weight value Va per predetermined unit time T0 and the obtained modifying material addition weight integrated value Vs per the predetermined unit time T0 as the target modifying material weight value. Then, in a modifying material specific gravity correction coefficient operation part 26, the controller 10 obtains a new modifying material specific gravity correction coefficient Kv according to the mathematical expression "Kw×P" with use of the obtained ratio P and the modifying material specific gravity correction coefficient Kv up to now, and updates this.

Meanwhile, the target processing weight of the raw soil material (target raw soil material weight Wj) per the predetermined unit time T0 and the target addition weight of the modifying material (in this example, this is obtained with "target raw soil material weight Wj×weight addition rate Vj") are set by the target processing amount setting means 21. In a processing amount comparison means 53, the controller 10 performs the comparison between the obtained actual raw soil material weight value Ws per the predetermined unit time T0 and the set target processing weight of the raw soil material (target raw soil material weight Wj), and the comparison between the obtained actual modifying material addition weight value Va per the predetermined unit time T0 and the set target addition weight of the modifying material, respectively, at each predetermined unit time T0. When a difference value between the actual raw soil material weight value Ws and the target processing weight of the raw soil material is a predetermined allowable value or larger, and/or a difference value between the actual modifying material addition weight value Va and the target addition weight of the modifying material is a predetermined allowable value or larger, the controller 10 outputs an alarm command to the alarm means By repeating the above-described processing, the value of the modifying material specific gravity used at the time of the control arithmetic operation can be corrected according to the value of the deviation between the actual measurement value and the target value of the modifying material addition weight. Consequently, if the initial set value of the modifying material specific gravity is different from the actual value, it is gradually corrected to a proper value, and based on this, the modifying material addition amount and the raw soil material processing amount are corrected to be controlled. Accordingly, the control is performed so that a decreasing curve of the modifying material weight actual measurement value is substantially equal to the target, specifically, the addition processing amount (addition speed) per hour of the modifying material becomes equal to the target value (see FIG. 5).

It is possible to correct the value of the raw soil material volume used at the time of controlling arithmetic operation, namely, the raw soil material target processing amount properly, corresponding to the value of a deviation between the actual measurement value and the target value of the raw soil material processing weight. Consequently, even if the set value of the modifying material specific gravity is different from the actual value, and if there is a variation in the driving speed of the modifying, material feeder, the raw soil material feeder and the like, they are corrected to a proper value, and based on this, the raw soil material processing amount per hour is corrected to be controlled. Accordingly, the actual processing weight per hour of the raw soil material is controlled to be substantially equal to the target value, and therefore modified soil with very good mixture ratio precision can be produced.

Figure 5:
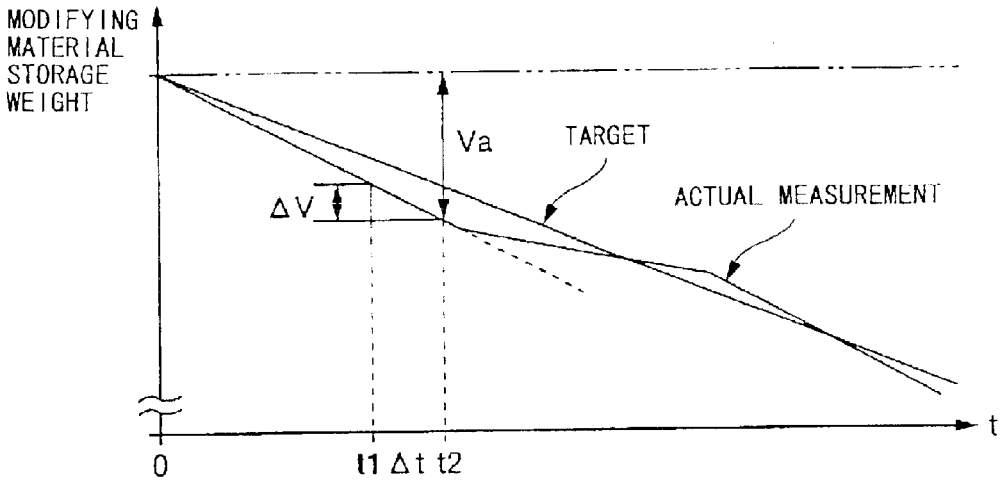
FIG. 5 is a change chart of a weight value measured with a load cell with respect to an elapsed time in the first embodiment.

Here, the arithmetic operation method in the actual modifying material addition weight value operation part 46 will be explained in detail based on FIG. 5 to FIG. 7. FIG. 5 shows a change of the weight value measured with the load cell 11 with respect to elapsed time. The weight value measured with the load cell 11 shows a total weight of the modifying material hopper 6, the modifying material feeder 6*b* and the modifying material stored in them, and it decreases at an angle of inclination according to the addition amount as the modifying material is added in the soil modifying operation. A difference value between the measurement values of the load cell 11 read at times t1 and t2 having an interval of a predetermined servo arithmetic operation period time Δt corresponds to a modifying material addition weight ΔV from the previous arithmetic operation processing time to the arithmetic operation processing time of this time. The integrated value of the modifying material addition weight ΔV is set to be an actual measurement modifying material addition weight integrated value Va.

Figure 6:
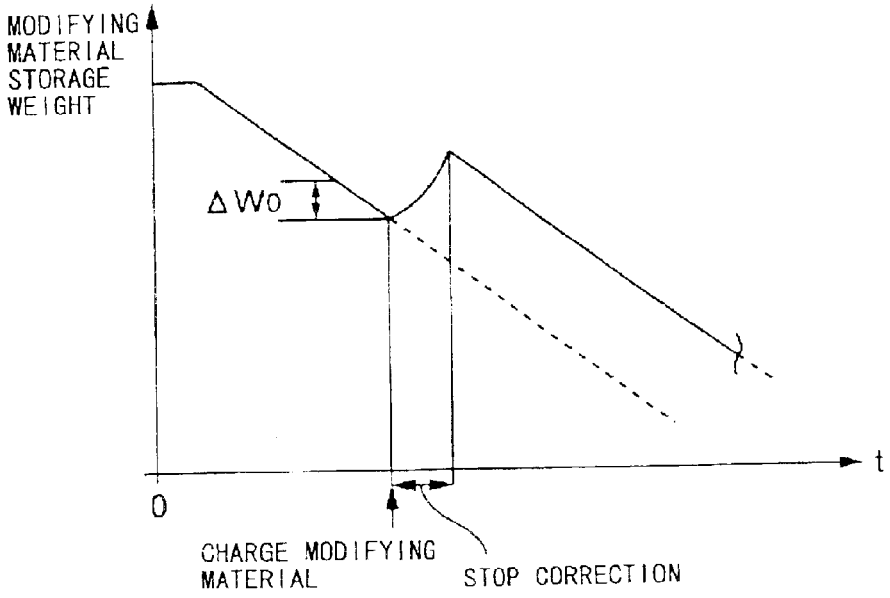
FIG. 6 is a change chart of a weight measurement value at the time of charging a modifying material in the first embodiment.
Figure 7:
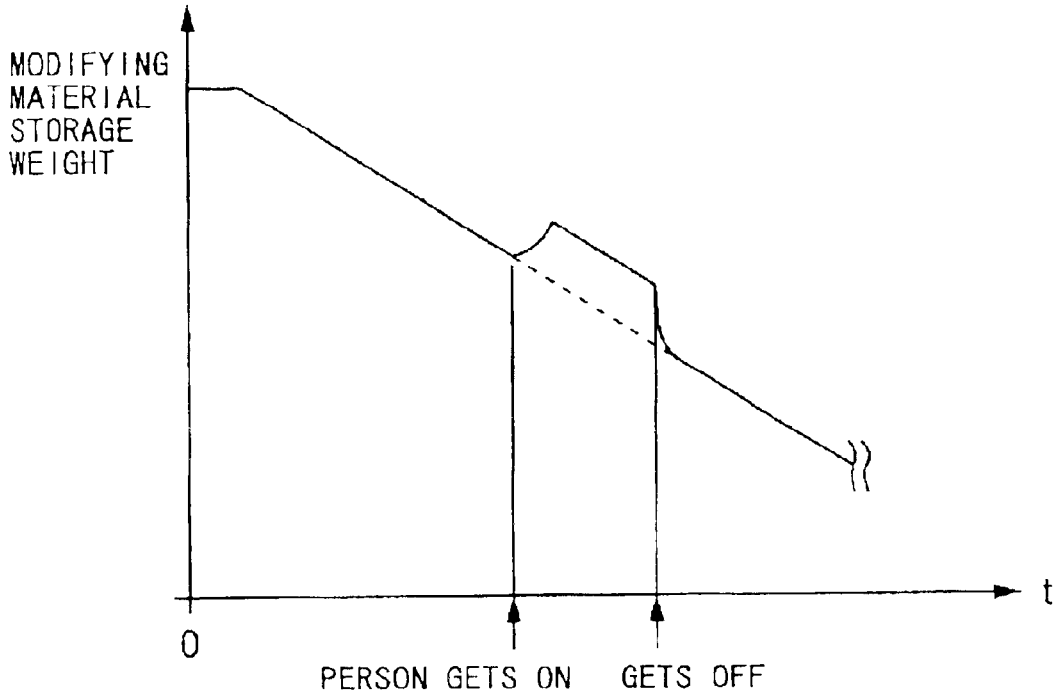
FIG. 7 is a change chart of the weight measurement value when a human being gets on and comes down from a modifying material hopper in the first embodiment.

Meanwhile, when the stored modifying material amount inside the modifying material hopper 6 is decreased, a worker charges the modifying material into the modifying material hopper 6 from a new modifying material bag, and therefore the weight measurement value is increased stepwise as shown in FIG. 6. When the worker performs monitoring, maintenance and the like of the modifying material hopper 6 and the area around it, he or she sometimes gets on or off the modifying material hopper 6 to work, and in this case, a stepwise increase or decrease in the weight measurement value also occurs as shown in FIG. 7. In the case of the self-propelled soil modifying apparatus, the weight measurement value sometimes varies following the vibration of the vehicle body when a modifying operation is performed while the self-propelled soil modifying apparatus travels. Such an abrupt increase or decrease of the weight measurement value becomes a cause of error (noise) in the arithmetic operation processing of the aforementioned actual measurement modifying material addition weight integrated value Va, and therefore the following processing is performed lo remove the influence thereof.

(Determination of generation of causes of error)

Generation of a cause of error is determined in at least any case of the followings:

(1) When the weight measurement value is deviated from the predicted line according to the decreasing tendency so far by a predetermined value or more.

(2) When the weight measurement value sharply changes at an angle of inclination of a predetermined value or more.

(Removal processing of the causes of error)

When the generation of the causes of error is determined, the following processing is performed.

(1) The measurement value of a sharp change amount at this time is ignored, the correction operation by update of the raw soil material volume correction coefficient K2 and the modifying material specific gravity correction coefficient Kv are stopped, and the control operation processing is performed with use of the coefficient used until then. During the stop of the correction operation, an alarm is given to the operator by ringing a chime or the like, lighting a warning lamp or the like, displaying a warning message, and the like.

(2) When a sharp change in the weight measurement value is stabilized after generation of the cause of error, the correction operation stop processing is automatically released, the modifying material addition weight based on the measurement value and the actual measurement modifying material addition weight integrated value Va are arithmetically operated, and updating of the above-described each coefficient according to this, and the correction operation according this update are restarted.

The releasing method of the correction operation stopping processing is not limited to what is described above, and for example, a release switch (not shown) or the like may be provided to make it possible to release the processing when the operator manually operates the release switch or the like after completion of charging the modified material, or after getting off the modifying material hopper 6 section.

In this manner, even if an external disturbance occurs to the measurement value of the modifying material weight, operation processing is performed to remove the influence of the external disturbance, and therefore the modifying material weight can be measured accurately, and thus making it possible to produce the modified soil with highly precise mixture ratio. Even if there are a change in specific gravity when the modified material is charged by air compression, a change in specific gravity in the upper part and the lower part of the modifying material hopper, and the like, the addition weight of the modifying material can be accurately managed.

EXAMPLE

Next, a detailed operation according to the above-described constitution will be explained with a concrete example. It is assumed that the raw soil material volume WT per hour is 60 $m^3$/H, and the initial value of the raw soil material volume correction coefficient Kw is 1.0. When the operation is started, the theoretical raw soil material volume W0 per hour is firstly obtained as 60 m3/H according to the mathematical expression "W0=WT/Kw=60/1.0". Then, the target speed command Ca of the raw soil material feeder 8 with respect to the theoretical raw soil material volume W0=60$m^3$/H is obtained, and based on the command Ca, the rotational frequency of the drive hydraulic motor 14 of the raw soil material feeder 8 is controlled. Then, during this time, the speed of the raw soil material feeder 8 is integrated in an hour (predetermined unit time T0), and based on the integrated value S2, the raw soil material volume integrated value Wa per one hour is obtained according to the mathematical expression "Wa=S2×U×Kw". Further, the first raw soil material weight integrated value Ww as the predicted value of the raw soil material processing weight value per one hour is arithmetically operated according to the mathematical expression "Ww=Wa×q". It is assumed that the first raw soil material weight integrated value Ww is 60 $m^3$/H. Next, the actual processing weight of the raw soil material (actual raw soil material weight value Ws) per one hour is arithmetically operated by subtracting the modifying material addition weight integrated value Vs as the actual modifying material addition amount from the actual modified soil production weight per one hour, which is obtained by the conveyor scale 12. If the obtained actual processing weight is 50 $m^3$/H, "50 $m^3$/H/60 $m^3$/H=5/6" is obtained as the ratio M of the actual processing weight and the target raw soil material weight (the first raw soil material weight integrated value Ww). Thereafter, the new raw soil material volume correction coefficient Kw is updated to 5/6 according to the mathematical expression "Kw×M".

Next, the theoretical raw soil material volume W0 per hour becomes 72 $m^3$/H according to the mathematical expression "W0=60/(5/6)" based on the new raw soil material volume correction coefficient K (=5/6). The target speed of the raw soil material feeder 8 is operated to attain 72 $m^3$ as described above, and the raw soil material feeder 8 is controlled, during which the speed of the raw soil material feeder 8 is integrated for one hour. Based on this integrated value S2, the raw soil material volume integrated value Wa per one hour is obtained according to the mathematical expression "Wa=S2×U×Kw", and the first raw soil material weight integrated value Ww is arithmetically operated according to the mathematical expression "Ww=Wa×q". Since the theoretical raw soil material volume W0 is 72 $m^3$/H at this time, "S2×U" becomes substantially equal to 72 $m^3$/H, but since "Kw=5/6" this time, the raw soil material volume integrated value Wa becomes substantially equal to 60 $m^3$/H, and therefore the first raw soil material volume integrated value Ww is assumed to be substantially equal to 60 $m^3$/H. This time, the actual processing weight of the raw soil material (raw soil material weight value Ws) per one hour is arithmetically operated based on the actual modified soil production weight per one hour obtained by the conveyor scale 12. If this actual processing weight is 62 $m^3$/H, "62/60=1.03" is obtained as the ratio M of the actual processing weight and the target raw soil material weight (the first raw soil material weight integrated value Ww). Thereafter, the new raw soil material volume correction coefficient Kw is updated to "(5/6)×1.03=0.86" according to the mathematical expression "Kw×M". Thereafter, the operation is repeated as described above.

According to this embodiment, the following effects can be obtained. The target processing amount of the raw soil material per hour (weight or volume is suitable) and the actual processing amount are compared, and based on the comparison result, the actual feeding speed of the raw soil material (namely, the speed command for the raw soil material feeder) is corrected and controlled so that the actual processing amount per hour becomes equal to the target processing amount. As a result, even if there are a variation in the drive motor torque of the raw soil material feeder, a variation in the loading amount into the raw soil material hopper 5, a change in the kind (specific gravity) of the raw soil material, and the like, the actual processing amount of the raw soil material per hour can be managed with respect to the target processing amount with excellent precision.

The target addition amount (weight or volume is suitable) of the modifying material per hour and the actual addition amount are compared, and based on the comparison result, the actual addition speed of the modifying material (namely, the speed command of the modifying material feeder) is corrected and controlled so that the actual addition amount per hour becomes equal to the target addition amount. As a result, even if there are a variation in the drive motor torque of the modifying material feeder, a variation in the loading amount into the modifying material hopper 6, a change in the specific gravity of the modifying material, and the like, the actual addition amount per hour of the modifying material can be managed with respect to the target addition amount with excellent precision.

As a result, the actual production amount per hour of the modified soil made by mixing the raw soil material and the modifying material can be controlled to be substantially equal to the target production amount, and therefore production management of the modified soil along the production plan can be carried out with excellent precision. Accordingly, the production speed can be always managed accurately, and production can be performed efficiently by keeping a predetermined proper production speed at low cost. Since the mixture ratio of the raw soil material and the modifying material can be always controlled with respect to the target value (desired value) with excellent precision, the modified soil with good quality can be produced. The actual processing amount of the raw soil material is measured with the conveyor scale, which is provided at the modified soil transfer conveyor to measure the weight of the modified soil to be discharged, or it is measured with the conveyor scale, which is provided at the raw soil material feeder to measure the weight of the raw soil material lo be supplied to the mixer, and therefore it can be accurately measured with the simple and compact constitution.

Since the actual addition amount of the modifying material is measured by the load cell for measuring the total added weight of the modifying material hopper, the modifying material feeder, and the modifying material stored inside them, the weight measuring sensor unit is sturdy, and accurate measurement can be made by integrating the difference of the measurement value at each predetermined measuring time. When the difference value between the actual processing amount per hour of the raw soil material (for example, the actual raw soil material weight value Ws) and the target processing, amount is a predetermined allowable value or more, and/or when the difference value between the actual addition processing amount per hour of the modifying material (for example, the actual modifying material addition weight value Va) and the target addition processing amount of the modifying material is a predetermined allowable value or more, it is notified by alarm, and therefore the operator can immediately handle with the abnormal condition. Consequently, the problem caused by continuing production for a long time without noticing the production in an abnormal condition can be prevented from occurring.

Figure 8:
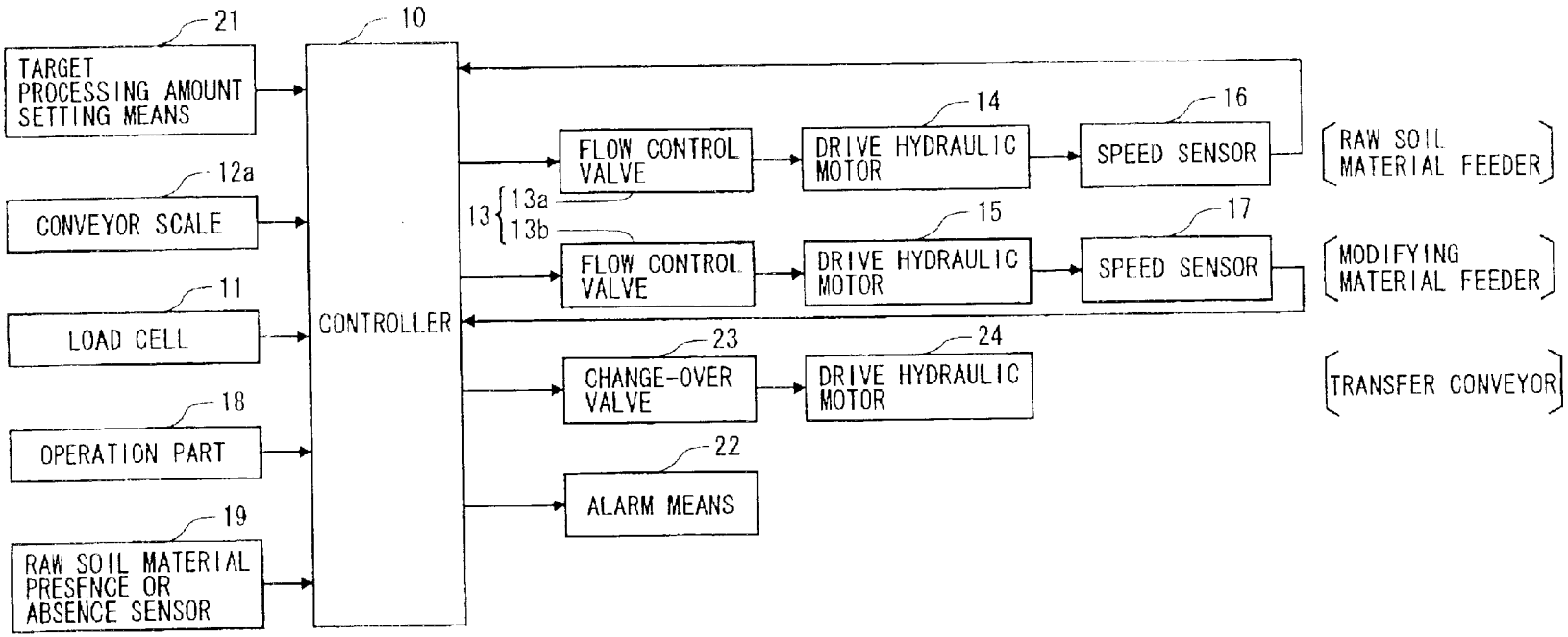
FIG. 8 is a block diagram of a constitution of a control unit according to a second embodiment of the present invention.
Figure 9:
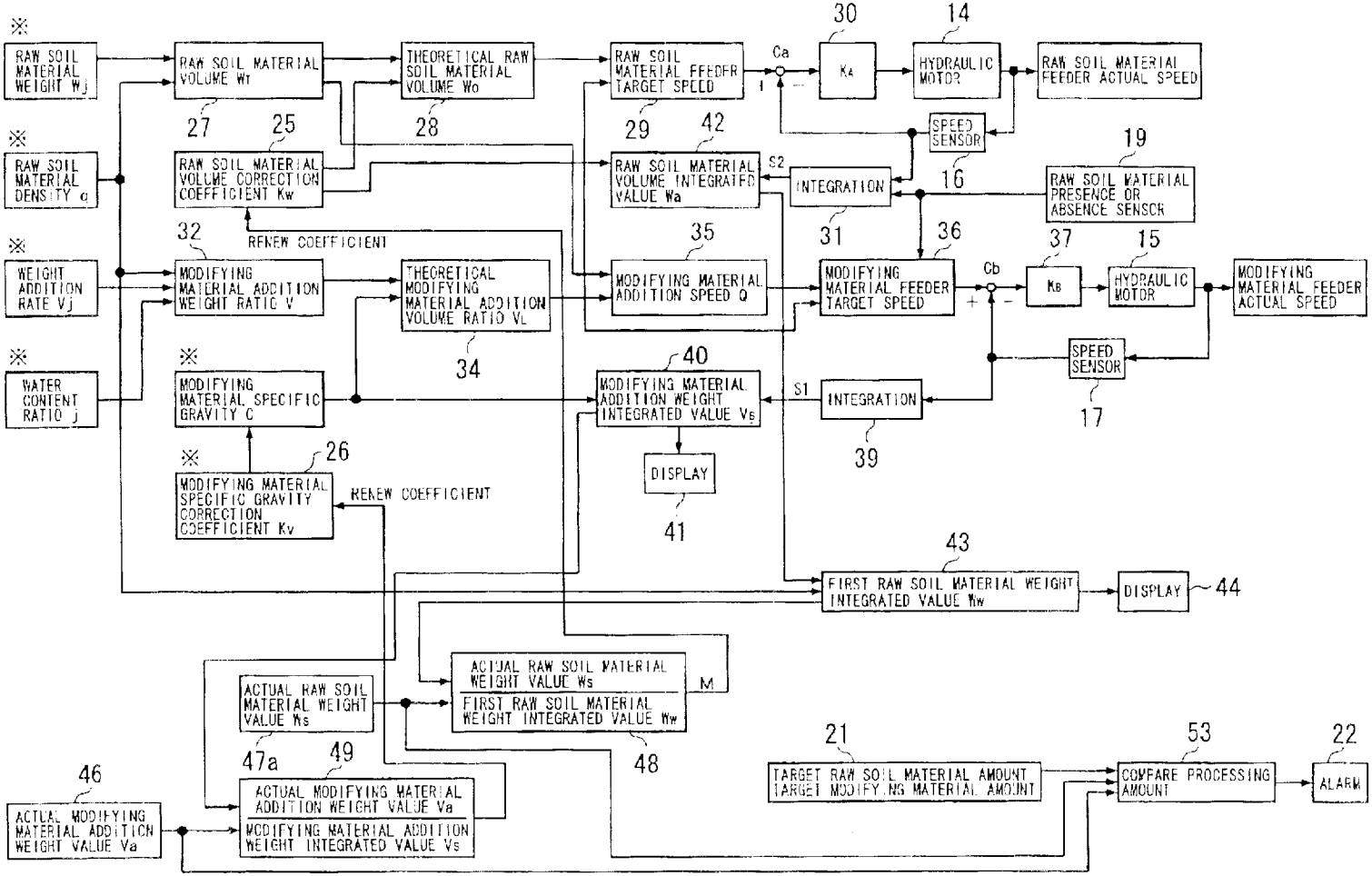
FIG. 9 is a block diagram of a control function of the second embodiment.
Figure 10:
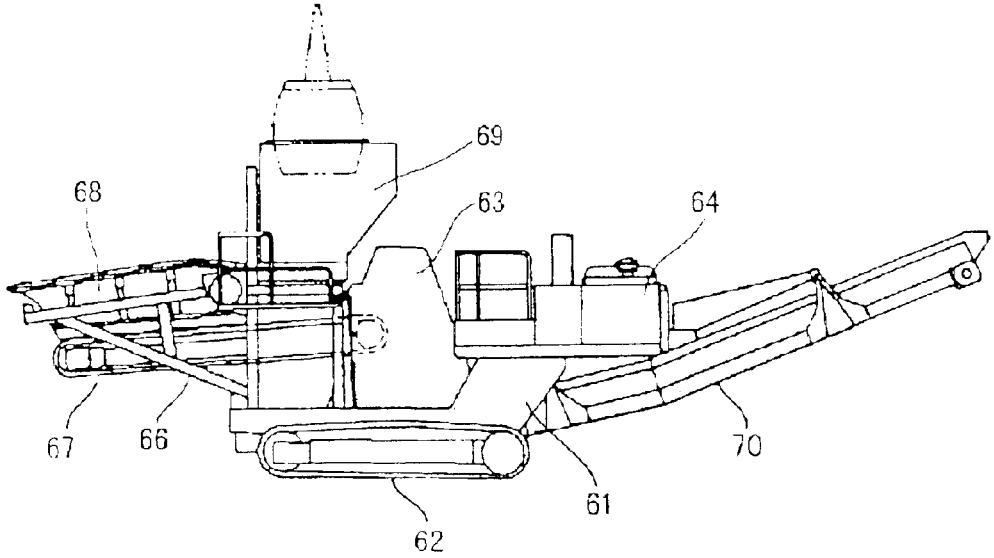
FIG. 10 Prior Art
FIG. 10 is a side view of a self-propelled soil modifying apparatus according to a prior art.

Next, a second embodiment will be explained based on FIG. 8 and FIG. 9. In these drawings, the same components as the components shown in FIGS. 3 and 4 in the first embodiment are given the same reference numerals and symbols, and the explanation thereof will be omitted here. Hardware constitutions will be explained based on a hardware constitution block diagram of a control unit shown in FIG. 8. In this embodiment, as actual raw soil material amount detecting means for detecting an actual processing amount of a raw soil material, a conveyor scale 12*a* for measuring an actual processing amount of a raw soil material supplied from the raw soil material hopper 5 is provided nearer to the raw soil material hopper 5 than the modifying material chute 6*a,* at the raw soil material feeder 8, as shown in FIG. 1. The measurement value of the conveyor scale 12*a* is inputted into the controller 10. The other hardware constitutions are the same as in the first embodiment.

The controller 10 has a high speed arithmetic unit and a storage unit (not shown) such as a computer, and it previously stores each data such as a modified soil target production amount inputted from the target processing amount setting means 21, a modifying material weight addition rate (mixture ratio), a raw soil material density, and a modifying material specific gravity inputted from the operation part 18 (or each data such as a raw soil material target processing amount, a modifying material target addition amount, and a modifying material specific gravity may be suitable). At the time of an actual control, the controller 10 inputs therein an actual processing amount of the raw soil material measured by the conveyor scale 12 a at each predetermined time, and an actual addition amount of the modifying material measured by the load cell 11 at each predetermined time, and performs predetermined arithmetic operation processing that will be described later based on these inputted data. The controller 10 corrects and controls the speed of the raw soil material feeder 8 and the modifying material feeder 6*b* based on a comparison result of the actual processing amount per hour of the raw soil material and the stored target processing amount, so that the actual processing amount of the raw soil material per hour becomes equal to the target processing amount. In this situation, if the actual processing amount per hour of the raw soil material is varied by a predetermined value or more with respect to the target processing amount, the controller 10 outputs an alarm command to the outside by the alarm means 22.

Next, a function constitution will be explained based on FIG. 9. An actual raw soil material weight value operation part 47*a* is provided instead of the modified soil measurement weight integrated value operation part 45 and the actual raw soil material weight value operation part 47 in the first embodiment. It is noted that in FIG. 9, the blocks given symbols "*" are the values set by an operator. However, only initial values of KW, C and KV are inputted by the operator. The actual raw soil material weight value operation part 47*a* integrates the raw soil material weight value measured by the conveyor scale 12*a* provided at the raw soil material feeder 8 at each predetermined measuring time for the predetermined unit time T0 (for example, one hour) and obtains the actual raw soil material weight value Ws per the predetermined unit time T0.

According to the second embodiment, the following effects can be obtained. The actual processing amount of the raw soil material is measured by the conveyor scale for measuring the weight of the raw soil material supplied to the mixer, which is provided at the raw soil material feeder, and therefore it can be accurately measured with the simple and compact constitution. Since the actual processing amount of the raw soil material is directly measured, the arithmetic operation error and the like are reduced, and excellent measurement accuracy is obtained. The other effects are the same as in the first embodiment, and therefore the explanation thereof will be omitted.

In the above-described first and second embodiments, the load cell is used as the measuring means for the modifying material weight, but this is not restrictive, and for example, a distortion gauge, a conveyor scale and the like may be used. The explanation is made with the example having the crawler type traveling unit as the self-propelled soil modifying apparatus, but a wheel type may be used.

As explained thus far, according to the present invention, the following effects can be obtained. In the soil modifying apparatus, the raw soil material supplying speed to the mixer is corrected to be controlled, based on the result of comparing the actual processing amount per hour of the raw soil material and the target processing amount, and the addition speed to the raw soil material is corrected to be controlled, based on the result of comparing the actual addition amount per hour of the modifying material and the target addition amount, and therefore the actual processing amount of the raw soil material and the modifying material per hour can be made substantially equal to the respective target values. Consequently, the actual production amount per hour of the modified soil can be controlled following the production plan with excellent precision, and therefore the production management of the modified soil can be performed with high precision. Accordingly, proper production speed can be accurately kept, and therefore production efficiency is enhanced, thus making it possible to produce modified soil at low cost. Further, the mixture ratio of the raw soil material and the modifying material can be managed at high precision, and modified soil of high quality can be produced.

What is claimed is:

1. A soil modifying apparatus, comprising:

target processing amount setting means for setting a target processing amount per hour of a raw soil material;

actual raw soil material amount detecting means for detecting an actual processing amount of the raw soil material in time sequence;

actual raw soil material amount calculating means for calculating an actual processing amount per hour of the raw soil material from a detection value of said actual raw soil material amount detecting means;

raw soil material feeder speed detecting means for detecting a speed of a raw soil material feeder;

predicted raw soil material amount calculating means for calculating a predicted supply amount per hour of the raw soil material based on the detected raw soil material feeder speed;

first comparing means for comparing the calculated actual processing amount per hour of the raw soil material, and the calculated predicted supply amount as a target processing amount per hour of the raw soil material; and raw soil material feeder speed correcting means for correcting a target value of the raw soil material feeder speed obtained from the set target processing amount per hour of the raw soil material, based on a comparison result of said first comparing means, and controlling the speed of said raw soil material feeder according to the corrected target value.

2. The raw soil modifying apparatus according to claim 1, wherein said actual raw soil material detecting means comprises a conveyer scale provided at said raw soil material feeder part for supplying the raw soil material to a mixer, or a conveyer scale provided at a modified soil discharging conveyor part for discharging modified soil to an outside from said mixer.

3. A soil modifying apparatus, comprising:

target processing amount setting means for setting a target addition processing amount per hour of a modifying material;

actual modifying material amount detecting means for detecting an actual addition processing amount of the modifying material in time sequence;

actual modifying material amount calculating means for calculating an actual addition processing amount per hour of the modifying material from a detection value of said actual modifying material amount detecting means;

modifying material feeder speed detecting means for detecting a speed of a modifying material feeder;

predicted modifying material amount calculating means for calculating a predicted addition amount per hour of the modifying material based on the detected modifying material feeder speed;

second comparing means for comparing the calculated actual addition processing amount per hour of the modifying material, and the calculated predicted addition amount as a target addition processing amount per hour of the modifying material; and modifying material feeder speed correcting means for correcting a target value of the modifying material feeder speed obtained from the set target addition processing amount per hour of the modifying material based on a comparison result of said second comparing means, and controlling the speed of said modifying material feeder according to the corrected target value.

4. The raw soil modifying apparatus according to claim 3, wherein said actual modifying material detecting means comprises a load cell for measuring weights of the modifying material and a modifying material hopper for storing the modifying material.

5. A soil modifying apparatus, comprising:

target processing amount setting means for setting a target processing amount per hour of a raw soil material, and a target addition processing amount per hour of a modifying material;

actual raw soil material amount detecting means for detecting an actual processing amount of the raw soil material in time sequence;

actual raw soil material amount calculating means for calculating an actual processing amount per hour of the raw soil material from a detection value of said actual raw soil material amount detecting means;

raw soil material feeder speed detecting means for detecting a speed of a raw soil material feeder;

predicted raw soil material amount calculating means for calculating a predicted supply amount per hour of the raw soil material based on the detected raw soil material feeder speed;

first comparing means for comparing the calculated actual processing amount per hour of the raw soil material, and the calculated predicted supply amount as a target processing amount per hour of the raw soil material;

raw soil material feeder speed correcting means for correcting a target value of the raw soil material feeder speed obtained from the set target processing amount per hour of the raw soil material, based on a comparison result of said first comparing means, and controlling the speed of the raw soil material feeder according to the corrected target value;

actual modifying material amount detecting means for detecting an actual addition processing amount of the modifying material in time sequence;

actual modifying material amount calculating means for calculating an actual addition processing amount per hour of the modifying material from a detection value of said actual modifying material amount detecting means;

modifying material feeder speed detecting means for detecting a speed of a modifying material feeder;

predicted modifying material amount calculating means for calculating a predicted addition amount per hour of the modifying material based on the detected modifying material feeder speed;

second comparing means for comparing the calculated actual addition processing amount per hour of the modifying material, and the calculated predicted addition amount as a target addition processing amount per hour of the modifying material; and modifying material feeder speed correcting means for correcting a target value of the modifying material feeder speed obtained from the set target addition processing amount per hour of the modifying material, based on a comparison result of said second comparing means, and controlling the speed of said modifying material feeder according to the corrected target value.

* * * * *